US008939216B2

(12) United States Patent
Nguyen

(10) Patent No.: US 8,939,216 B2
(45) Date of Patent: Jan. 27, 2015

(54) SYSTEM AND METHOD FOR SNUBBING UNDER PRESSURE

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 525 days.

(21) Appl. No.: 12/744,010

(22) PCT Filed: Dec. 16, 2008

(86) PCT No.: PCT/US2008/087046
§ 371 (c)(1),
(2), (4) Date: May 20, 2010

(87) PCT Pub. No.: WO2009/085780
PCT Pub. Date: Jul. 9, 2009

(65) Prior Publication Data

US 2010/0243268 A1 Sep. 30, 2010

Related U.S. Application Data

(60) Provisional application No. 61/015,574, filed on Dec. 20, 2007.

(51) Int. Cl.
*E21B 34/02* (2006.01)
*E21B 33/129* (2006.01)

(52) U.S. Cl.
CPC ..... *E21B 33/1294* (2013.01)
USPC ..... 166/373; 166/386; 166/332.7

(58) Field of Classification Search
USPC ..... 166/331, 188, 91.1, 87.1, 82.1, 83.1, 166/332.7, 386, 387, 126–128, 131, 133, 166/135, 142, 145, 148–152, 184–186, 192
See application file for complete search history.

(56) References Cited

U.S. PATENT DOCUMENTS 1,842,270 A * 1/1932 Johnston ..... 166/150
2,170,057 A * 8/1939 Kerr ..... 166/85.1

(Continued)

FOREIGN PATENT DOCUMENTS

EP 1233145 8/2002
GB 2287267 9/1995

(Continued)

OTHER PUBLICATIONS

Schlumberger Oilfield Glossary entry for "J-Slot", accessed Jul. 17, 2013 via www.glossary.oilfield.slb.com.*

(Continued)

*Primary Examiner* — Blake Michener
(74) *Attorney, Agent, or Firm* — Fletcher Yoder, P.C.

(57) ABSTRACT

A snubbing plug is configured to enable pressure equalization above and below the plug before it is removed from a mineral extraction well. The pressure may be equalized via fluid pathways through the snubbing plug. While the snubbing operations are ongoing, the fluid pathways are closed and sealed by a valve. Upon completion of the snubbing operations, the valve is opened to enable fluid flow through the pathways. The valve includes a piston disposed within a body of the snubbing plug. The piston may be coupled to pins disposed within L slots in the body. While the valve is closed, the pins are disposed in a horizontal portion of the L slot, blocking vertical movement of the piston. To open the valve, the piston is rotated until the pins reach a vertical portion of the L slot, whereupon a spring biases the piston upward to open the fluid pathways.

26 Claims, 5 Drawing Sheets

(56) References Cited

U.S. PATENT DOCUMENTS

| | | | | | |
|---|---|---|---|---|---|
| 2,397,472 | A | * | 4/1946 | Crowell | 166/128 |
| 2,919,709 | A | * | 1/1960 | Schwegman | 137/68.17 |
| 2,935,132 | A | * | 5/1960 | Arterbury et al. | 166/202 |
| 3,065,796 | A | * | 11/1962 | Nutter | 166/331 |
| 3,105,553 | A | * | 10/1963 | Chisholm | 166/133 |
| 3,141,506 | A | * | 7/1964 | Thomas | 166/332.5 |
| 3,249,124 | A | * | 5/1966 | Berryman | 137/629 |
| 3,250,331 | A | | 5/1966 | Boyle | |
| 3,581,819 | A | * | 6/1971 | Tamplen | 166/332.7 |
| 3,610,337 | A | * | 10/1971 | Lewis | 166/331 |
| 3,662,826 | A | * | 5/1972 | Young et al. | 166/152 |
| 3,897,824 | A | | 8/1975 | Fisher | |
| 3,954,138 | A | | 5/1976 | Miffre | |
| 3,965,978 | A | * | 6/1976 | Conley et al. | 166/113 |
| 3,987,848 | A | * | 10/1976 | Canterbury | 166/321 |
| 4,018,276 | A | * | 4/1977 | Bode | 166/183 |
| 4,058,162 | A | * | 11/1977 | Smith | 166/124 |
| 4,121,660 | A | * | 10/1978 | Koleilat | 166/135 |
| 4,260,020 | A | * | 4/1981 | Nelson et al. | 166/305.1 |
| 4,391,324 | A | * | 7/1983 | Reed | 166/70 |
| 4,576,196 | A | * | 3/1986 | Ross et al. | 166/318 |
| 4,804,042 | A | * | 2/1989 | Knight et al. | 166/184 |
| 4,825,945 | A | * | 5/1989 | Smith | 166/87.1 |
| 4,836,287 | A | * | 6/1989 | Eric et al. | 166/321 |
| 4,986,357 | A | * | 1/1991 | Pringle | 166/319 |
| 5,398,764 | A | * | 3/1995 | Collins | 166/382 |
| 5,474,124 | A | * | 12/1995 | Samuels et al. | 166/85.1 |
| 5,509,476 | A | | 4/1996 | Vick, Jr. | |
| 6,095,249 | A | * | 8/2000 | McGarian et al. | 166/319 |
| 6,290,004 | B1 | * | 9/2001 | Evans | 175/296 |
| 6,427,773 | B1 | * | 8/2002 | Albers | 166/185 |
| 6,730,236 | B2 | * | 5/2004 | Kouba | 210/806 |
| 6,889,771 | B1 | * | 5/2005 | Leising et al. | 166/373 |
| 7,219,752 | B2 | * | 5/2007 | Wassell et al. | 175/321 |
| 7,516,786 | B2 | * | 4/2009 | Dallas et al. | 166/250.08 |
| 7,527,104 | B2 | * | 5/2009 | Branch et al. | 166/331 |
| 2004/0084190 | A1 | * | 5/2004 | Hill et al. | 166/386 |
| 2005/0167095 | A1 | * | 8/2005 | Nguyen | 166/88.2 |
| 2007/0204986 | A1 | | 9/2007 | Sorhus | |
| 2010/0258319 | A1 | * | 10/2010 | Nguyen et al. | 166/373 |
| 2011/0011575 | A1 | * | 1/2011 | Nguyen et al. | 166/87.1 |
| 2011/0011598 | A1 | * | 1/2011 | Nguyen et al. | 166/386 |
| 2011/0036596 | A1 | * | 2/2011 | Nguyen et al. | 166/386 |

FOREIGN PATENT DOCUMENTS

| | | |
|---|---|---|
| GB | 2312455 | 10/1997 |
| WO | WO0183938 | 11/2001 |

OTHER PUBLICATIONS

Schlumberger Oilfield Glossary entries for "wellhead" and "running tool", accessed Jan. 7, 2014 via www.glossary.oilfield.slb.com.*

Dictionary definition of "bearing", accessed Jan. 7, 2014 via thefreedictionary.com.*

Dictionary definitions of "coupled" and "joined" accessed Mar. 17, 2014 via thefreedictionary.com.*

PCT International Search Report and Written Opinion for PCTUS2008/087046, dated Jul. 27, 2009.

International Search Report and Written Opinion for PCT/US2009/035166, dated Sep. 22, 2009.

* cited by examiner

SYSTEM AND METHOD FOR SNUBBING UNDER PRESSURE

CROSS-REFERENCE TO RELATED APPLICATIONS

This application claims priority to and benefit of PCT Patent Application No. PCT/US2008/087046, entitled "System and Method for Snubbing Under Pressure," filed Dec. 16, 2008, which is herein incorporated by reference in its entirety, and which claims priority to and benefit of U.S. Provisional Patent Application No. 61/015,571, entitled "System and Method for Snubbing Under Pressure", filed on Dec. 20, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to myriad other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

In some instances, well intervention, or any work involving maintenance, modification, repair, or completion of the well, may be performed by first killing the well and then removing pressure control equipment to enable pipes and/or tools to be lowered into the well. Well kill involves adding heavy fluid to a wellbore, thereby preventing the flow of reservoir fluids from the well. The heavy fluid provides enough pressure to overcome the pressure of the reservoir fluids such that pressure control equipment may be removed from the wellhead assembly to enable completion of the desired intervention. The heavy fluid introduced into the wellbore may impair the resumption of fluid flow after the well intervention is completed. That is, to resume production after killing the well, the heavy fluids must be removed from the wellbore.

As an alternative to killing the well to enable intervention work, a technique known as snubbing may be employed while the well is under pressure. In snubbing, a plug is inserted into the well, for example, in the tubing spool. Pressure is thereby isolated below the plug, and repairs or modifications may be made to well components above the plug. When the well intervention is complete, the snubbing plug may be removed and well operations may proceed as usual.

BRIEF DESCRIPTION OF THE DRAWINGS

Various features, aspects, and advantages of the present invention will become better understood when the following detailed description is read with reference to the accompanying figure, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

As discussed further below, snubbing operations may be conducted while the well is under pressure. There is generally a securing device which holds the snubbing plug in place during the course of well intervention. After the well intervention is complete, the snubbing plug may be removed. However, due to the difference in pressure above and below the plug, the plug and its associated tool and rod may be rapidly ejected upon releasing the snubbing plug. Accordingly, in certain embodiment discussed below, a pressure equilibration mechanism may be incorporated into the snubbing plug to equalize pressure above and below the plug. By providing a fluid path through the snubbing plug, the pressure equilibration mechanism may equalize pressure above and below the snubbing plug before the snubbing plug is removed from the wellhead.

Figure 1:
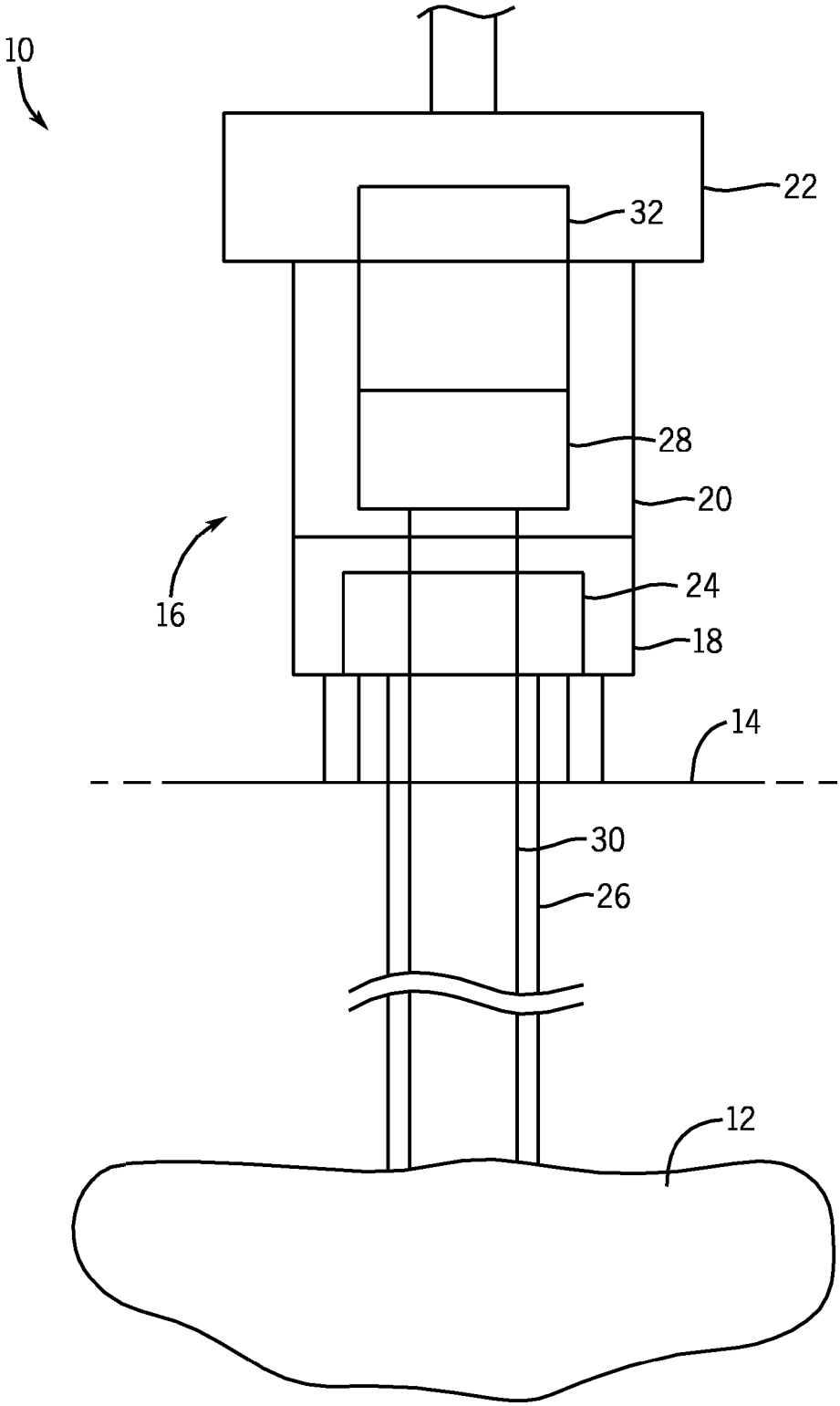
FIG. 1 is a block diagram of a mineral extraction system in accordance with embodiments of the present invention.

FIG. 1 illustrates a mineral extraction system 10 equipped for snubbing operations in accordance with exemplary embodiments of the present technique. The mineral extraction system 10 may be configured to extract minerals, such as oil and gas, from a mineral deposit 12 beneath a surface 14. In various embodiments, the mineral deposit 12 may be located under the sea floor or under dry land.

The illustrated mineral extraction system 10 includes a wellhead 16 having a casing spool 18, a tubing spool 20, and a blowout preventer 22. The casing spool 18 houses a casing hanger 24 from which a casing 26 is supported. Similarly, the tubing spool 20 has a tubing hanger 28 supporting a production tubing 30. Multiple tubings may be disposed concentrically within the casing 26. The production tubing 30 may be utilized to transfer minerals from the mineral deposit 12 to the wellhead 16. Other tubings and/or the casing 26 may be utilized to transport various production fluids to and from the mineral deposit 12.

In order to enable well intervention without killing the well, a snubbing plug 32 may be disposed above the tubing hanger 28. The snubbing plug 32 may substantially seal the wellhead 16 during snubbing operations, while equilibrating pressure above and below the snubbing plug 32 before the plug 32 is removed from the wellhead 16. In the illustrated embodiment, the snubbing plug 32 is disposed below the blowout preventer 22 such that any unexpected pressure release from the well may be contained by the blowout preventer 22 so that minerals are not released into the environment. Additional blowout preventers 22 may be installed above the snubbing plug 32 such that one or more blowout preventers 22 may be opened to enable running in and removal of the snubbing plug 32.

Figure 2:
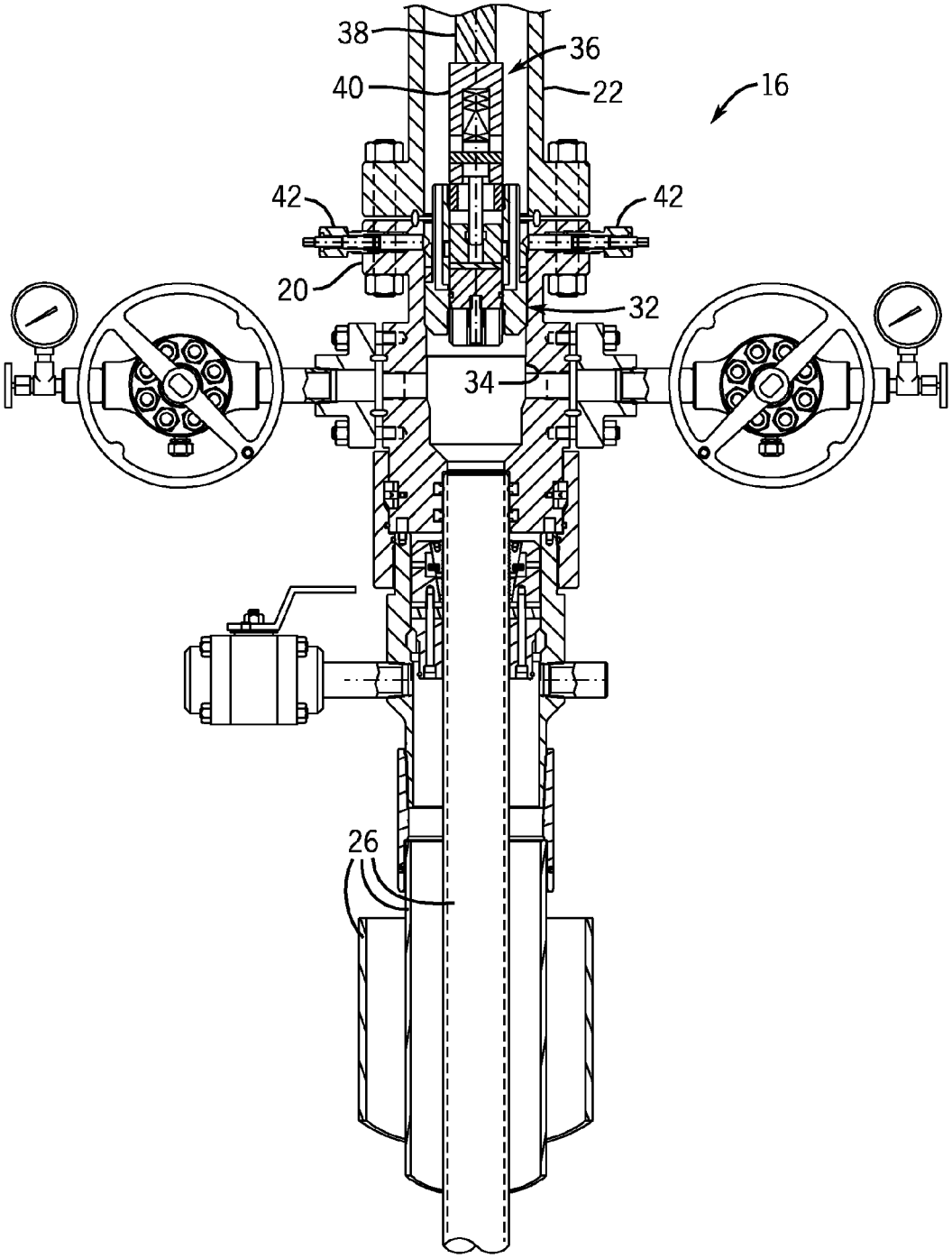
FIG. 2 is a partial cross-section of well components that may be used in the mineral extraction system illustrated in FIG. 1.

FIG. 2 is a partial cross-section of components of the well 16 illustrated in FIG. 1. An exemplary embodiment of the snubbing plug 32 is illustrated disposed within a bore 34 in the tubing spool 20. The snubbing plug 32 may be seated in the tubing spool 20 and manipulated via a snubbing tool 36. The snubbing tool 36 may include a rod 38 connected to control equipment, such as a snubbing basket or lubricator (not shown). The rod 38 is coupled to the snubbing plug 32 by a tool adapter 40, described in more detail below. Tie-down screws 42 may energize and secure the snubbing plug 32 within the tubing spool 20. That is, as well pressure below the snubbing plug 32 imparts an upward force on the plug 32, the tie-down screws 42 hold the snubbing plug 32 within the tubing spool 20.

Furthermore, one or more blowout preventers 22 may be disposed above the snubbing plug 32 to ensure that minerals are not ejected from the well 16 and to facilitate the insertion and removal of the snubbing plug 32. That is, as the snubbing tool 36 lowers the snubbing plug 32 into the well 16, various blowout preventers 22 may be opened and closed to ensure that the well remains sealed. For example, a first blowout preventer may be opened while the snubbing plug 32 passes therethrough and a second blowout preventer remains closed. The first blowout preventer may then be closed and the second opened to enable passage of the snubbing plug 32 therethrough.

Figure 3:
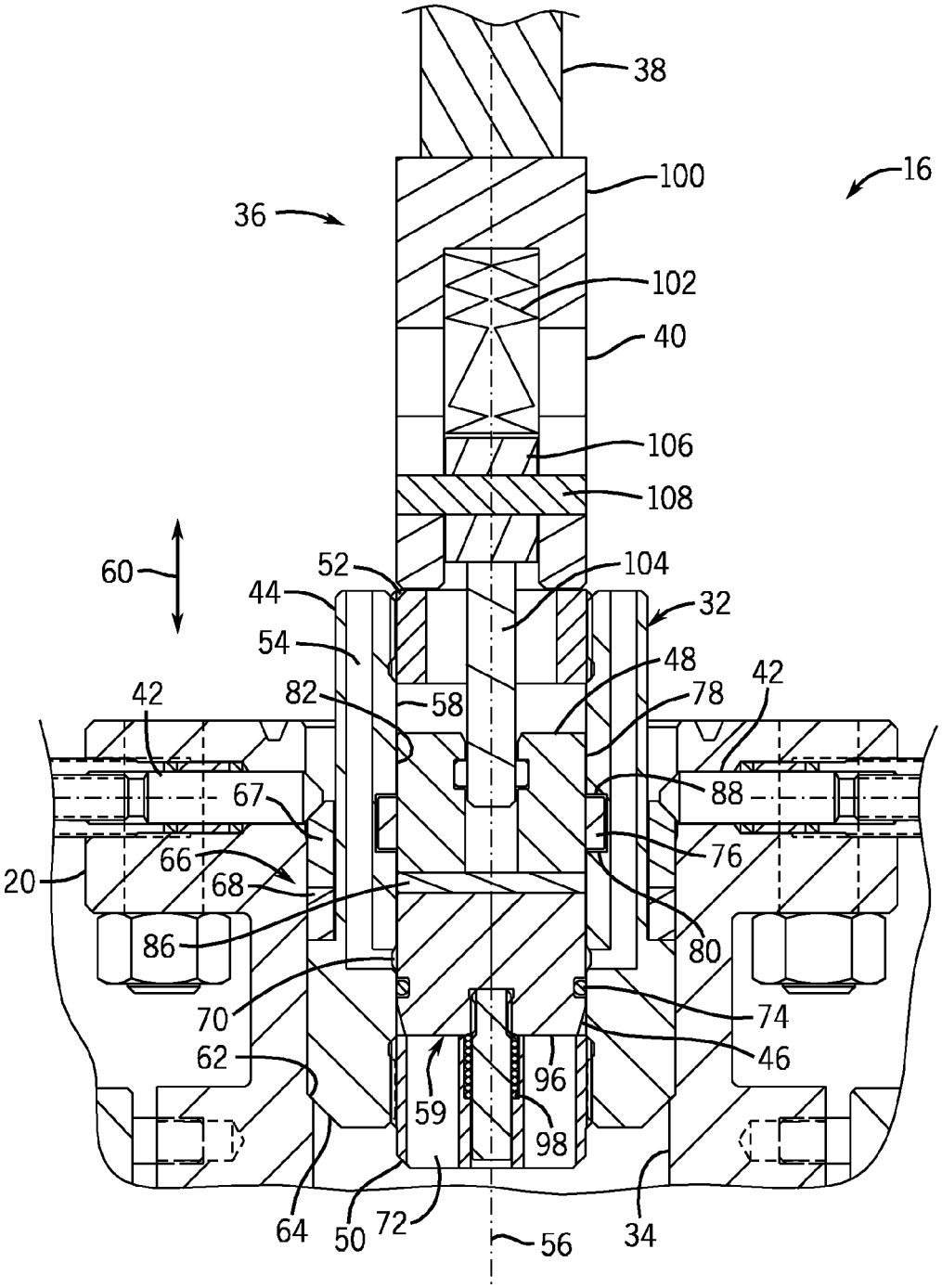
FIGS. 3 and 4 are partial cross-sections of a snubbing plug that may be used in the mineral extraction system illustrated in FIG. 1.
Figure 4:
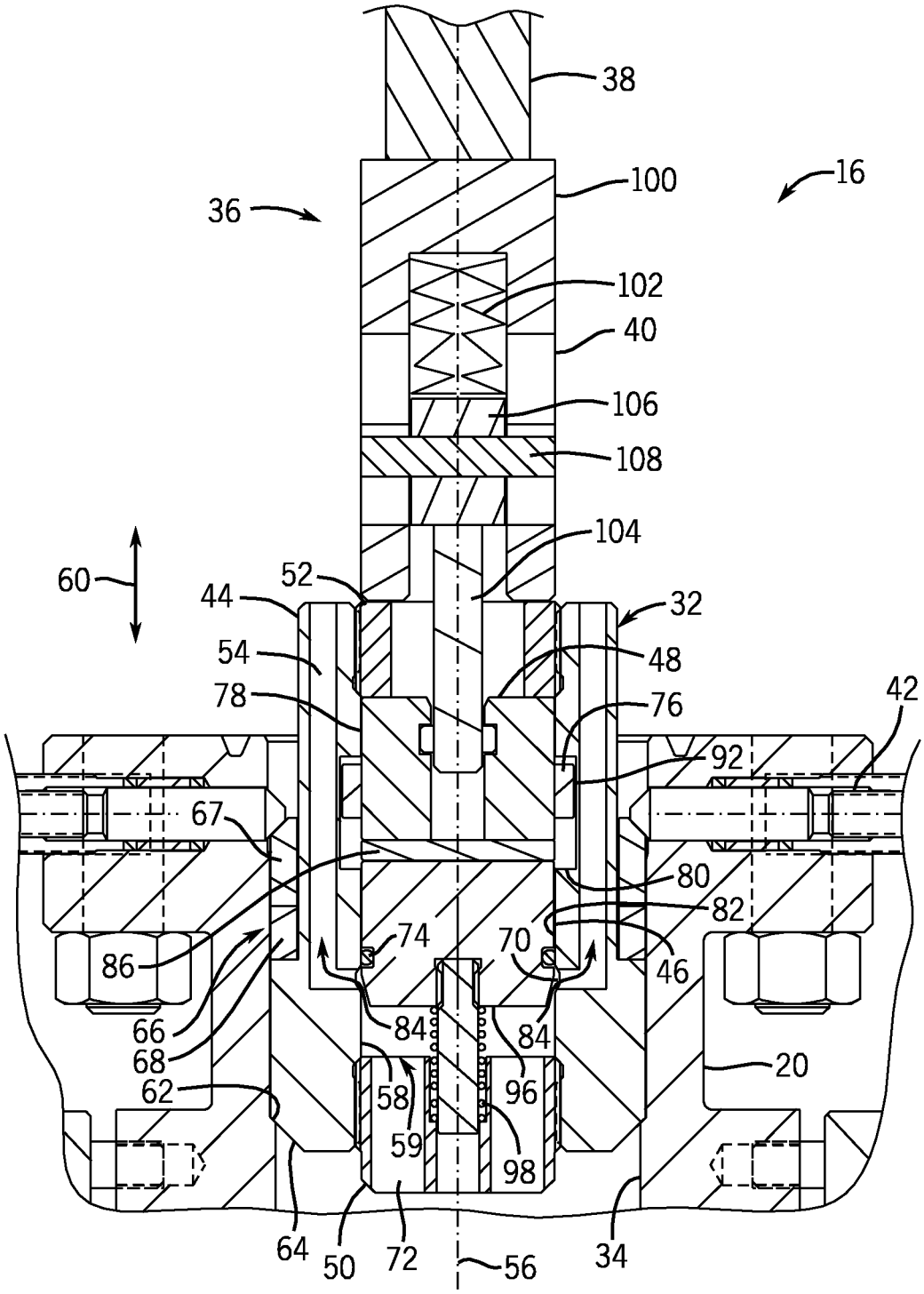
Figure 5:
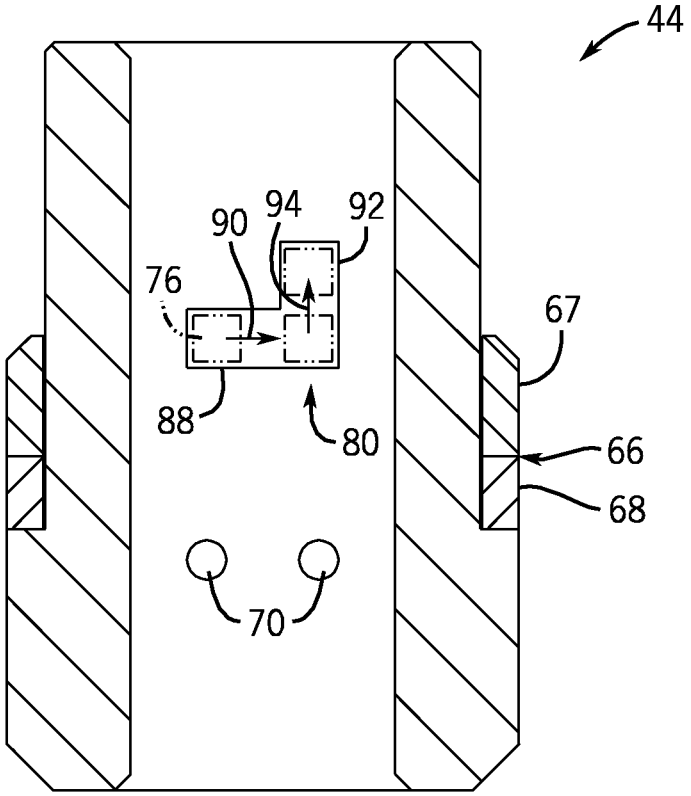
FIG. 5 is a partial cross-section of a component of the snubbing plug illustrated in FIGS. 3 and 4.

More features of the exemplary snubbing plug 32 are illustrated in FIGS. 3-5. FIGS. 3 and 4 illustrate the snubbing plug 32 disposed within the bore 34 in the tubing spool 20. The snubbing plug 32 may generally include a body 44, a piston 46, a load ring 48, and hold-down rings 50 and 52. The body 44 may include a plurality of holes 54 running therethrough along a longitudinal axis 56. The piston 46 and the load ring 48 may be coupled together and disposed within a bore 58 in the body 44. The piston 46 and the load ring 48 operate as a valve 59 to seal and open the holes 54. That is, the piston 46 and coupled load ring 48 may move axially along the axis 56, as indicated by an arrow 60, within the bore 58 such that the holes 54 are covered when the valve 59 is in the closed position (FIG. 3) and uncovered when the valve 59 is in the open position (FIG. 4). The hold-down rings 50 and 52 secure the piston 46 and the load ring 48 within the bore 58.

In addition, the snubbing plug 32 is secured within the tubing spool 20 by the tie-down screws 42 and a landing shoulder 62 in the bore 34. The bore 34 decreases in diameter to create the landing shoulder 62, which may be flat (e.g., disc-shaped) or angled (e.g., conical), as in the illustrated embodiment. A corresponding shoulder 64 on the snubbing plug 32 may also be flat (e.g., disc-shaped) or angled (e.g., conical). The landing shoulders 62 and 64 cooperate to stop the snubbing plug 32 from advancing further into the tubing spool 20.

After the snubbing plug 32 is inserted into the tubing spool 20, the tie-down screws 42 may be tightened to protrude radially into the bore 34. In an exemplary embodiment, a composite seal ring 66 is disposed around the body 44 such that the tie-down screws 42 act on an energizing portion 67 to compress a seal portion 68. That is, inward radial movement of the tie-down screws 42 exerts a downward axial force (i.e., along the arrow 60) on the energizing portion 67 of the composite ring 66, compressing the seal portion 68 as the screws 42 advance into the bore 34. As the seal portion 68 is compressed axially (i.e., vertically along the arrow 60), it expands radially/horizontally and forms a seal between the body 44 and the bore 34. To enable compression, the energizing portion 67 may be composed of a rigid material while the seal portion 68 is composed of an elastic material, such as rubber. The seal formed by the ring 66 blocks pressure from escaping around the snubbing plug 32.

Referring now to FIG. 3, the valve 59 is shown closed. That is, the piston 46 covers openings 70 to the holes 54. The hold-down ring 50 has one or more passages 72 therethrough which enable fluid pressure to act upon the piston 46 from below the snubbing plug 32. A sealing ring 74 disposed around the piston 46 is situated below the openings 70, thereby sealing the holes 54 from the fluid pressure.

Furthermore, the piston 46 is blocked from axial movement (i.e., vertically along the arrow 60) while the snubbing plug 32 is sealed. One or more pins 76 protruding radially outward from an outer surface 78 of the load ring 48 cooperate with one or more "L" slots 80 in an inner surface 82 of the body 44 to lock the valve 59 in the closed position.

When snubbing operations are complete, the valve 59 may be opened, as illustrated in FIG. 4, to enable equalization of the fluid pressure above and below the snubbing plug 32. That is, higher-pressure fluid below the snubbing plug 32 may flow through the holes 54 to the lower-pressure region above the plug 32, as indicated by arrows 84.

The "L" slots 80 enable the piston 46 to be raised without ejecting the snubbing tool 36 from the well. The load ring 48 and the piston 46 may be rotated around the axis 56 facilitated by a bearing 86 disposed axially between the piston 46 and the load ring 48. During rotation, the pin 76 slides along a circumferential or horizontal portion 88 of the slot 80, as indicated by an arrow 90 in FIG. 5. Upon reaching an axial or vertical portion 92 of the slot 80, the pin 76 moves axially up, as indicated by an arrow 94 in FIG. 5.

Multiple forces may act to bias the valve 59 open. Referring again to FIG. 4, fluid pressure may exert an upward axial force on a bottom surface 96 of the piston 46. In addition, a spring 98 disposed between the piston 46 and the hold-down ring 50 biases the piston 46 upward. The hold-down ring 52 may stop the upward axial movement (i.e., vertically along the arrow 60) of the load ring 48 and the piston 46.

Furthermore, the tool adapter 40 may absorb the axial movement of the load ring 48 and the piston 46 so that the rod 38 does not move relative to the snubbing plug 32 or the well 16 (FIG. 2). For example, the tool adapter 40 may include a body 100 housing a spring 102. A shaft 104 connects the load ring 48 to a piston 106 within the adapter body 100. A pin 108 couples the piston 106 to the adapter body 100 such that the piston 106 may move axially (i.e., vertically along the arrow 60) but not rotationally (i.e., around the axis 56) relative to the body 100. When the valve 59 is closed (FIG. 3), the spring 102 is stretched in a state of tension.

Upon opening the valve 59 (FIG. 4), the spring 102 is compressed within the body 100. While the shaft 104 and coupled piston 106 move axially (i.e., vertically along the arrow 60) with the valve 59, the body 100 and the rod 38 attached thereto do not move axially with respect to the snubbing plug 32. In addition, because the pin 108 blocks rotational movement of the shaft 104 relative to the body 100, the shaft 104 may be rotated about the axis 56 by rotating the body 100 and/or the rod 38, thereby rotating the load ring 48 and its pins 76 within the "L" slots 80, as described above.

In summary, the snubbing plug 32 may be installed into the tubing spool 20 via the snubbing tool 36. The plug 32 may be seated on the landing shoulder 62 within the bore 34 of the tubing spool 20. After inserting the snubbing plug 32 into the tubing spool 20, the tie-down screws may be advanced radially into the bore 34, thereby securing the snubbing plug 32. In the course of well intervention operations, the valve 59 in the snubbing plug 32 may remain closed, preventing the transfer of higher pressure from below the plug 32 to a lower pressure region above the plug 32.

When it is time to remove the snubbing plug 32, the valve 59 is first opened to equilibrate the pressure above and below the plug 32. The valve 59 may be opened by rotating the snubbing tool 36, which is coupled to the valve 59 in the snubbing plug 32 via the tool adapter 40. The valve 59 includes the piston 46, the load ring 48, the bearing 86, and the pins 76. Upon rotation of the valve 59, the pins 76 move circumferentially then axially within the "L" slots 80 of the plug body 44. As the valve 59 moves axially upward (i.e., vertically along the arrow 60), the opening 70 of the holes 54 through the body 44 are opened, thereby enabling the pressure above and below the plug 32 to equilibrate. The tie-down screws 42 may then be backed out of the bore 34, and the snubbing plug 32 may be removed from the tubing spool 20.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:
a wellhead; and
a plug mounted in the wellhead, wherein the plug comprises:
a body, comprising:
a central bore; and
one or more radial holes in fluid communication with the central bore and with an exterior of the plug;
a valve disposed within the central bore, wherein the valve is configured to open the one or more radial holes in an open position to equalize pressure above and below the plug while running the plug into the wellhead, and the valve is configured to close the one or more radial holes in a closed position after running the plug into the wellhead;
wherein the valve is configured to move between the open and the closed positions via rotation followed by axial movement or axial movement followed by rotation.

2. The system of claim 1, wherein the valve comprises a pin disposed within an L-shaped slot configured to restrict movement of the valve.

3. The system of claim 1, wherein the valve comprises a piston.

4. The system of claim 1, comprising a tapered ring adjacent a resilient ring, wherein the tapered ring is configured to move axially in response to a radial force against a taper of the tapered ring to compress the resilient ring.

5. The system of claim 1, wherein the plug comprises a first axial ring and a second axial ring, and wherein a first axial end of the valve contacts the first axial ring and a second axial end of the valve contacts the second axial ring as the valve moves between the first axial ring and the second axial ring.

6. The system of claim 5, wherein the plug comprises a first spring between the first axial ring and the first axial end of the valve.

7. The system of claim 1, wherein the plug comprises a spring configured to bias the valve towards the open position.

8. A system, comprising:
a wellhead;
a plug mounted in the wellhead, wherein the plug comprises:
a body having a central bore and one or more radial fluid pathways configured to enable pressure equalization of a region above and a region below the plug; and
an L-shaped slot in the body of the plug;
a valve comprising a bearing between a first portion of the valve and a second portion of the valve, wherein the valve is configured to open and close the one or more radial fluid pathways through the plug;
a pin protruding radially from the valve and disposed within the L-shaped slot; and
a spring configured to bias the valve toward an open position.

9. The plug of claim 8, wherein the pin is configured to travel along the L-shaped slot to open and close the valve.

10. The plug of claim 8, wherein the spring is configured to bias the valve toward the open position when the pin is disposed in an axial portion of the L-shaped slot.

11. The plug of claim 8, wherein the pin is coupled to the valve.

12. A system, comprising:
a running tool comprising:
a rod configured to rotate; and
an adapter coupled directly to the rod, the adapter is configured to removably connect or disconnect the running tool with a plug having a valve while in a wellhead, the adapter is configured to be positioned axially between the rod and the valve, wherein the adapter is configured to move the valve in the plug via only rotation followed by only axial movement or only axial movement followed by only rotation, and the axial movement of the valve is absorbed by the adapter such that the rod does not move axially relative to the plug when the valve opens.

13. The system of claim 12, wherein the adapter comprises a body having a spring configured to absorb the axial movement.

14. The system of claim 12, wherein the plug comprises a central bore with one or more radial holes in fluid communication with the central bore, and the valve is disposed within the central bore and configured to open and close the one or more radial holes.

15. The system of claim 12, wherein the plug comprises a spring configured to bias the valve toward an open position.

16. A method, comprising:
lowering a plug into a wellhead;
equalizing pressure in a first region above and a second region below the plug while lowering the plug into the wellhead wherein equalizing pressure comprises opening a fluid pathway through the plug by opening a valve along the fluid pathway, and wherein opening the valve comprises rotating a tool coupled to the valve;

mounting the plug in the wellhead; and closing the fluid pathway through the plug by closing the valve.

17. The method of claim 16, wherein a tool adapter couples to the valve.

18. The method of claim 16, comprising removing the plug from the wellhead while equalizing pressure above and below the plug.

19. The system of claim 16, wherein the fluid pathway comprises a central bore with one or more radial holes in fluid communication with the central bore, and the valve is disposed within the central bore and configured to open and close the one or more radial holes.

20. The system of claim 16, wherein the plug comprises a spring configured to bias the valve toward an open position.

21. A system, comprising:

a plug comprising a valve and a first spring configured to bias the valve in an open position; and a tool comprising an adapter configured to removably axially connect or disconnect with the valve while in a wellhead, wherein the tool is configured to open and close the valve via rotation followed by axial movement, and wherein the adapter comprises a second spring that absorbs axial movement of the valve to block movement of the tool when the valve opens.

22. The system of claim 21, wherein the tool comprises the adapter and a rod, wherein the adapter is configured to absorb axial movement of the valve such that the rod does not move axially relative to the plug.

23. The system of claim 21, wherein the plug comprises a central bore with one or more radial holes in fluid communication with the central bore, and the valve is disposed within the central bore and configured to open and close the one or more radial holes.

24. A system, comprising:

a wellhead; and a plug mounted in the wellhead, wherein the plug comprises:

a body, comprising:

a central bore; and one or more radial holes in fluid communication with the central bore and with an exterior of the plug;

a valve disposed within the central bore, wherein the valve is configured to open the one or more radial holes in an open position to equalize pressure above and below the plug while running the plug into the wellhead, and the valve is configured to close the one or more radial holes in a closed position after running the plug into the wellhead;

a first axial ring and a second axial ring, wherein a first axial end of the valve contacts the first axial ring and a second axial end of the valve contacts the second axial ring as the valve moves between the first axial ring and the second axial ring; and a first spring between the first axial ring and the first axial end of the valve.

25. A system, comprising:

a wellhead; and a plug mounted in the wellhead, wherein the plug comprises:

a body, comprising:

a central bore; and one or more radial holes in fluid communication with the central bore and with an exterior of the plug;

a valve disposed within the central bore, wherein the valve is configured to open the one or more radial holes in an open position to equalize pressure above and below the plug while running the plug into the wellhead, and the valve is configured to close the one or more radial holes in a closed position after running the plug into the wellhead; and a spring configured to bias the valve towards the open position.

26. A method, comprising:

lowering a plug into a wellhead;

equalizing pressure in a first region above and a second region below the plug while lowering the plug into the wellhead wherein equalizing pressure comprises opening a fluid pathway through the plug by opening a valve along the fluid pathway, and wherein the plug comprises a spring configured to bias the valve toward an open position;

mounting the plug in the wellhead; and closing the fluid pathway through the plug by closing the valve.

* * * * *